US012768099B2

(12) United States Patent
Pennington et al.

(10) Patent No.: US 12,768,099 B2
(45) Date of Patent: Oct. 20, 2026

(54) FIRE RESISTANT GLOVE AND METHODS OF MANUFACTURE

(71) Applicant: Matmarket, LLC, Portsmouth, NH (US)

(72) Inventors: Matthew Pennington, Stratham, NH (US); Cooper-Jinha Jung, Pusan (KR); Jae-Kap Lee, Daegu City (KR)

(73) Assignee: Matmarket, LLC, Portsmouth, NH (US)

( * ) Notice: Subject to any disclaimer, the term of this patent is extended or adjusted under 35 U.S.C. 154(b) by 0 days.

(21) Appl. No.: 18/745,195

(22) Filed: Jun. 17, 2024

(65) Prior Publication Data

US 2024/0426049 A1 Dec. 26, 2024

Related U.S. Application Data

(60) Provisional application No. 63/509,780, filed on Jun. 23, 2023.

(51) Int. Cl.

| | |
|---|---|
| ***D06N 3/14*** | (2006.01) |
| ***A41D 19/015*** | (2006.01) |
| ***D06N 3/00*** | (2006.01) |
| ***D06N 3/12*** | (2006.01) |

(52) U.S. Cl.

CPC ..... *D06N 3/14* (2013.01); *A41D 19/01529* (2013.01); *D06N 3/0009* (2013.01); *D06N 3/0015* (2013.01); *D06N 3/0059* (2013.01); *D06N 3/128* (2013.01); *D06N 2201/042* (2013.01); *D06N 2209/067* (2013.01); *D06N 2209/106* (2013.01); *D06N 2211/103* (2013.01)

(58) Field of Classification Search

CPC ..... D06N 3/14; D06N 3/0009; D06N 3/0015; D06N 3/0059; D06N 3/128; D06N 2201/042; D06N 2209/067; D06N 2209/106; D06N 2211/103; A41D 19/01529

See application file for complete search history.

(56) References Cited

U.S. PATENT DOCUMENTS

| | | | | |
|---|---|---|---|---|
| 4,259,377 | A * | 3/1981 | Baize | B29C 41/14 118/321 |
| 5,254,391 | A * | 10/1993 | Davis | D06M 15/227 428/68 |
| 10,383,378 | B1 * | 8/2019 | Ptah | A61H 7/001 |
| 2005/0058794 | A1 * | 3/2005 | Fujisawa | A63B 41/08 428/143 |
| 2016/0120242 | A1 * | 5/2016 | Thompson | A41D 19/001 2/169 |

* cited by examiner

*Primary Examiner* — James M Mellott
(74) *Attorney, Agent, or Firm* — SLEMAN & LUND LLP

(57) ABSTRACT

In some examples, a fire-resistant work glove includes a cotton base layer with a denier ranging from 150 to 200, and a polyurethane impregnated in the cotton base layer.

10 Claims, 8 Drawing Sheets

| Material | Thickness (mm) | Base Thickness (mm) | Total Weight (gr/sqm) | Base Fabric Weight (gr/sqm) | Total PU Weight (gr/sqm) | PU Weight Absorbed (gr/0.1 mm of base fabric) |
|---|---|---|---|---|---|---|
| Preferred 100% Cotton | 0.75-0.9 | 0.6-0.78 | 440-580 | 130-240 | 310-350 | 42.3-52 |
| Recycled Polyester | 0.85 | 0.7 | 400 | 220 | 180 | 26 |
| Recycled Polyester | 0.85 | 0.7 | 450 | 252 | 198 | 28 |
| Recycled Polyester | 0.85 | 0.4 | 230 | 150 | 80 | 20 |

FIG. 1C

| Property | Units | Results |
|---|---|---|
| Thickness | mm | 0.65 - 0.85 |
| Weight | $g/m^2$ | 400-480 |
| Tensile Strength | kg/in | > 14<br>> 8 |
| Elongation | % | 30-70<br>120-170 |
| Tear Strength | kg | > 1.5<br>> 1.3 |
| Abrasion (Taber) | Cycles | >700 |
| Crocking Dry<br>Wet | AATCC 8 | 3<br>2.5 |
| Solvent Wicking | Nike G49 | 3 |
| PVC Migration | DIN 53343 | 3 |
| UV / Sun Test | ASTM D1148 | 3 |

Post Treatment – 1(Silicon Wet Grip Surface treatment)

Post Treatment – 2(Backside flame-retardant coating)

FIRE RESISTANT GLOVE AND METHODS OF MANUFACTURE

CROSS-REFERENCE TO RELATED APPLICATIONS

This application claims priority to U.S. Provisional Ser. No. 63/509,780, filed Jun. 23, 2023, the contents of which are hereby incorporated by reference as if fully set forth herein.

FIELD OF THE DISCLOSURE

The present disclosure relates generally to gloves. More specifically, the present disclosure relates to work gloves having fire retardant properties.

BACKGROUND

Many industrial occupations necessitate the use of fire-retardant materials to meet safety standards. This includes professions involving potential flame exposure and handling high-temperature objects. Such occupations span a wide range, from firefighters to kitchen workers dealing with hot pans and ovens. Gloves with fire and heat resistance are essential to prevent burns and injuries. Not only do these gloves shield hands from burns, but they also enable the safe handling of hot objects. For example, without heat and flame resistant gloves, there is a risk of dropping a hot item, potentially causing harm to other body parts due to blunt force or tripping hazards.

U.S. Pat. No. 9,655,393 discloses a flexible, multi-layer glove with flame resistant qualities. It achieves the flexibility and flame resistance via multiple layers of material. Among the layers are flame-treated leather and para-aramid fibers. A plurality of attachment tabs is adhered to the fingers and fingertips to provide support without extra stiffness.

U.S. Pat. No. 9,079,050 discloses a similar glove with flame-resistant materials claiming improved dexterity. The glove is constructed of many layers including a liner, a webbed adhesive layer, a moisture barrier, and a flame-resistant shell.

U.S. Pat. No. 4,847,918 discloses a flexible and fire-retardant glove where a heat insulating inner glove is mounted and cemented to a water-tight, vapor permeable plastic glove. A flexible reinforcement element of the outline of the outer glove is then cemented to one face of the outer glove. Secure tabs are then stitched or tacked to the tips of the fingers and the glove is then reversed (inside out). The glove is made up of four layers of material and cement.

U.S. Pat. No. 7,681,417 discloses a heat resistant fabric and glove. The heat resistant fabric is created from a heat-resistant fiber yarn and a fancy twist yarn. The heat resistant glove is formed from a knitted fabric with the heat resistant yarn more present on the outer surface and the fancy twist yarn more present on the inner surface. The fabric with inner and outer faces that perform different duties allows the glove to made with better dexterity. However, to achieve the greater flexibility and dexterity, a complicated yarn and textile is required, making the product more expensive and not as readily available as products and materials made with standard production processes.

It is common in the art to use natural materials such as leather that do not burn, and many common glove products use leather as a fire-retardant layer. The use of leather makes the glove stiff and, therefore, reduces dexterity as well as rendering the glove difficult to wash. Moreover, while much of the prior art produces products that are fire-resistant, doing so brings with it a certain amount of complexity in fiber types, yarns, and glove construction to achieve a workable product that enhances dexterity and can be produced at a cost amenable to an average worker's budget.

SUMMARY OF THE DISCLOSURE

In some examples, a fire-resistant work glove includes a cotton base layer with a denier ranging from 150 to 200, and a silicone coating, or polyurethane impregnated in the cotton base layer.

In some examples, a method of making a work glove includes providing a cotton base layer with a denier ranging from 150 to 200, and impregnating the cotton base layer with a polyurethane.

BRIEF DESCRIPTION OF THE FIGURES

Various embodiments of the presently disclosed work gloves are shown herein with reference to the drawings, wherein:

FIG. 1C is a table that includes material properties for various base materials, including the cotton knit fabric;

Figure 1A:
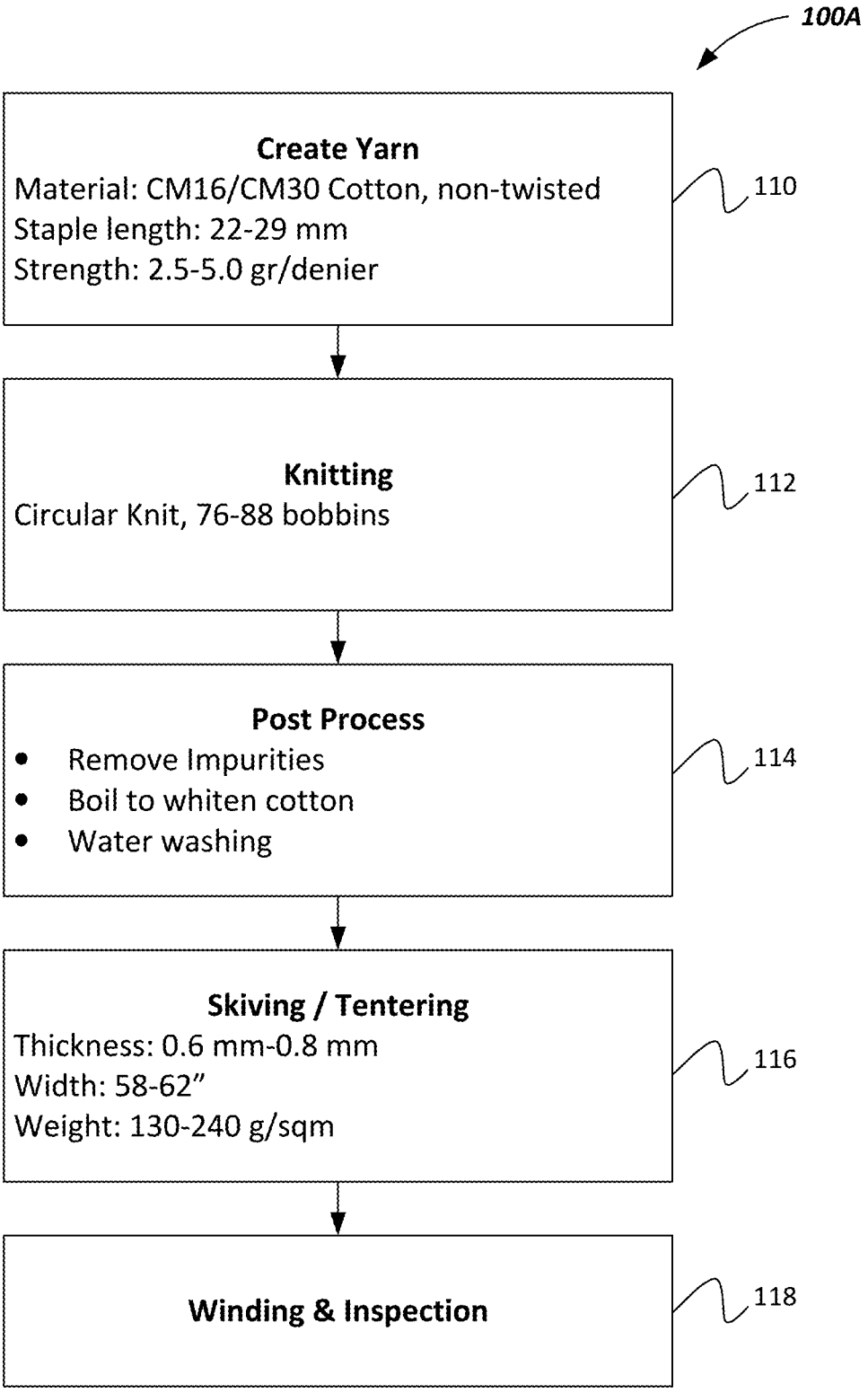
FIG. 1A is a schematic flowchart showing the creation of a fabric according to one embodiment.

Various embodiments of the present invention will now be described with reference to the appended drawings. It is to be appreciated that these drawings depict only some embodiments of the invention and are therefore not to be considered limiting of its scope.

DETAILED DESCRIPTION OF THE FIGURES

Despite the various improvements that have been made to work gloves and their methods of manufacture, conventional devices suffer from some shortcomings as described above. There therefore is a need for further improvements to the devices, systems, and methods of making work gloves. Among other advantages, the present disclosure may address one or more of these needs.

Fire-resistant gloves have been made for many years using various techniques. Conventional methods included making a fire-resistant glove by using a heat resistant fiber such as an aramid fiber, or fibers such as polybenzimidazole fiber, polyamide fiber, or melamine fiber. Such fibers are woven or knitted into a fabric which is then cut, stitched, and shaped into a glove.

Natural materials, such as leather, have also been used in fire-resistant gloves as leather is naturally fire and heat resistant. Plastic resins with high melt points and low flammability have also been used in fire-resistant gloves. These resins have high melting points and are either layered on top of or imbedded in other natural or synthetic materials. These resins can resist temperatures in excess of 200 degrees Celsius but will eventually melt if the temperature exceeds the melting point for a long enough period of time. While the use of synthetic fibers, natural materials, or plastic resin in fire-resistant gloves will provide some level of heat and fire resistance, placing these materials in a glove while maintaining other important properties of a glove is a challenge.

There are many properties that are important for gloves. Warmth, abrasion protection, grip improvement, cushioning, comfort, and dexterity are all important in overall glove performance. One disadvantage in the construction of fire-resistant gloves is that in order to achieve specific levels of fire resistance, the use of thick fabrics and/or natural materials such as leather is required. As the thickness of these materials increases, the other desirable glove features such as dexterity and comfort are reduced.

In some embodiments, a work glove is created having exceptional flame-resistant qualities at a low cost, the work glove providing exceptional dexterity. The gloves of the present disclosure achieve a high level of fire and heat resistance while maintaining comfort and dexterity. In order for a glove to be protective it needs to be worn by the user. An uncomfortable glove might be removed by the user, thus endangering the wearer. A glove with low dexterity might cause the user to remove the glove to gain dexterity for a particular task and endanger the wearer while the glove is removed. The combination of fire and heat resistance in a glove that does not reduce comfort and dexterity creates a glove with exceptional safety. The comfort and dexterity allow the wearer to keep the glove on the hand at all times, even in situations that require fine motor skills. A fire-resistant glove that is worn at all times is the best defense in occupations where the danger of flame exists.

Figure 1B:
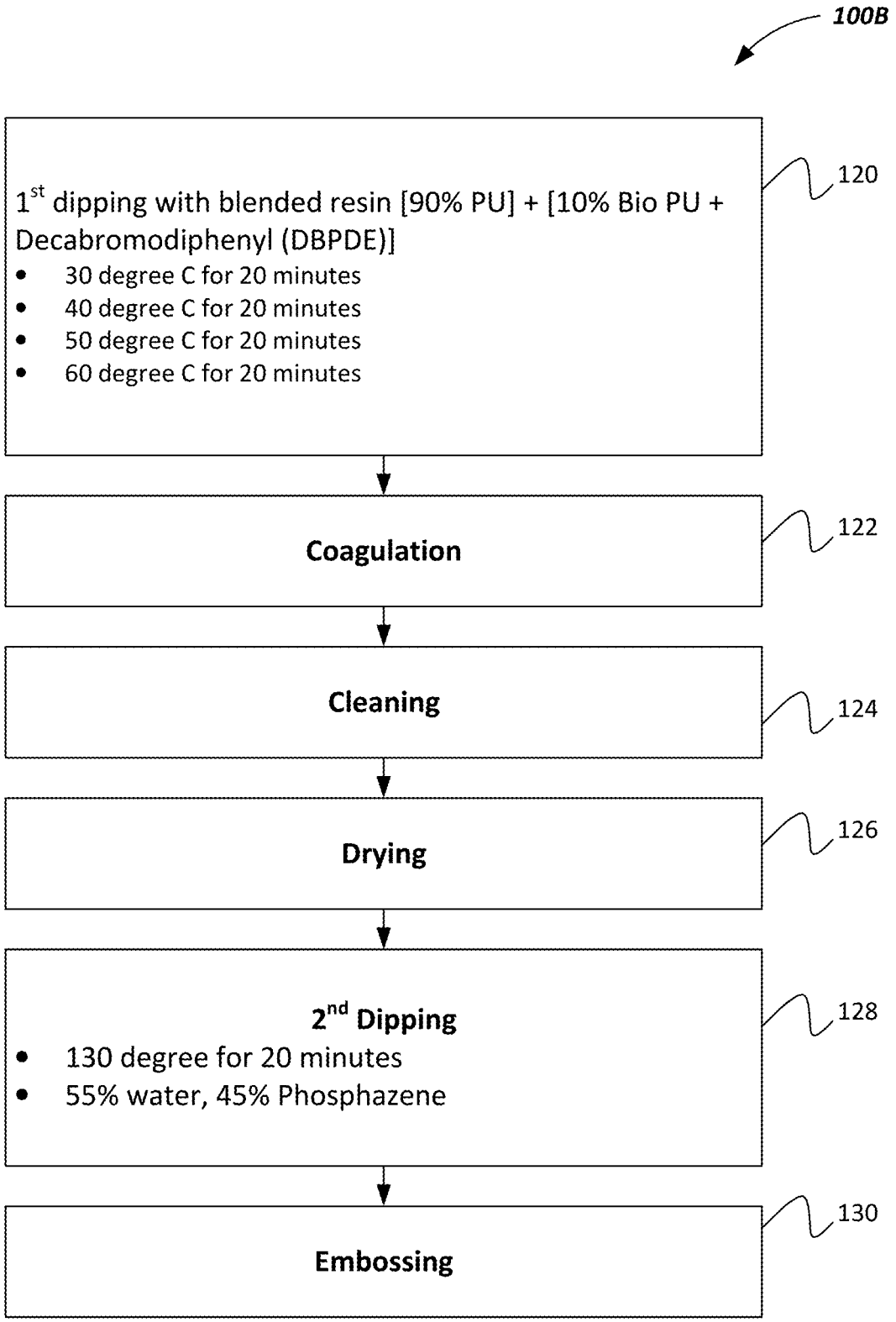
FIG. 1B is a schematic flowchart showing the coating and/or impregnation of the fabric described in FIG. 1A.

FIGS. 1A-B are schematic flowcharts that illustrate the overall process of producing a preferred material with fire resistance properties. As shown in FIG. 1A, the first step in producing the work glove is a first subprocess 100A of creating the base fabric. First a yarn is created in step 110 that is preferred for use in the fire-resistant glove manufacturing. In some examples, the yarn includes a non-twisted, CM30 cotton, with a staple length of 22-29 mm. CM16 cotton may also be used in other examples. In some examples, the yarn has a relatively high volume-to-weight ratio to provide a lofted cotton. In some examples, the high-lofted cotton allows for a large volume of fire-resistant polyurethane to flow into the lofted cotton and provide fire resistant properties. The yarn is ideally at a strength of about 2.5 to 5.0 grams/denier. In some examples, a CM30 cotton yarn with a denier of 172 is used, which makes it desirable for these purposes. While other cotton variations may work equally well, a cotton close to CM16-CM30 is desired. Ideally the cotton yarn has a denier ranging from 150 to 200.

In step 112, the base cotton material may be knitted using, for example, a circular knit process. As one familiar with the circular knit process will know, yarn is placed on bobbins, and numerous bobbins are placed in a circle around the knitting head. The above process may utilize a total of 76-84 bobbins for the circular knit process that produces a high volume, fine denier cotton knit. While the above-mentioned base cotton fabric is made from Brazilian cotton, other types of cotton can work as effectively if the denier and strength properties are maintained.

Using the circular knit process, a fabric with ideal properties is created. Ideally, the circular knitted cotton has a tensile strength of greater than 14 kg/in in one direction and greater than 8.0 kg/in of strength in a second direction. The weight of the cotton may be between 130 g/m2-240 g/m2 with a thickness of 0.60 mm-0.80 mm (e.g., 0.65 mm). The width of the cotton fabric may be in the range of, and including, 58 inches-62 inches. A post process is performed in step 114. For example, the cotton may be boiled to improve the physical properties, specifically UV protection, which increases the life of the cotton fabric. Following the knitting process, the fabric may also be washed to remove impurities and then skived and tentered to set the thickness, width, and weight (step 116). In step 118, a winding and inspection process is performed prior to impregnation.

FIG. 1C shows a table that includes material properties for various base materials, including the cotton knit fabric. In some examples, the thickness of the cotton is between 0.50 and 0.70 mm (e.g., 0.6 or 0.78 mm) with a weight of 130 g/sqm-240 g/sqm, similar to that shown in FIG. 1C. Although cotton is generally not a preferred yarn for gloves designed to be made for the industrial/protection industry, however, the above cotton, when used with the below process can produce a glove with exceptional fire resistance properties with enhanced comfort and dexterity. Of course, other materials such as other variations of cotton, recycled polyester, nylon, TPU or combinations thereof may also be used.

In FIG. 1C, the thickness and weight of different fabrics are shown, as well as the amount of fire-resistant polyurethane absorbed by the fabrics. As shown, the cotton material that was tested may be relatively thin, but absorbs 1.5× more polyurethane than the next best polyester material. The hyper-saturation of the fire-resistant polyurethane material into and around the cotton base improves flame resistance as compared to conventional materials and processes. In some examples, the cotton base absorbs 45-52 grams (or 62 grams) of fire-resistant polyurethane per 0.1 mm of fabric. This provides a large amount of flame resistance in a thin material. Once this material is used in a glove it provides excellent flame resistance in a thin glove to increase comfort and dexterity.

With the fabric set, a second subprocess 100B may proceed, which includes coating and/or impregnating the cotton fabric with a preferred fire-resistant polymer. Specifically, once the fabric has been knitted and prepared, the next step is to flow a polyurethane resin into the cotton fabric to impregnate and intermix with the cotton fabric. A preferred blended resin may be used to impregnate the fabric using the steps shown in FIG. 1B. It will be understood that one or more of these steps may be optional and that certain steps may be repeated.

Prior to a first dip, a blended resin of polyurethane, bio-based polymer, and DBPDE may be created. The chemicals are poured into a container simultaneously and a screw mixer is used to blend the chemicals. Mixing time is approximately 2 hours to ensure the heterogenous set of chemicals is thoroughly mixed. The Bio-based polyurethane is an oil-based polyurethane that uses corn as it's bio content for the polyol component of the polyurethane. A petroleum-based, aromatic isocyanate is used for the isocyanate component of the polyurethane. Bio content of the polymer is approximately 35%.

In step 120, a first dip may be performed using a blended resin of 90% polyurethane, 10% Bio-based polymer (e.g., bio-based polyurethane) and Decabromodiphenyl (DBPDE) at 30 degrees Celsius for 20 minutes. Step 120 may include a cleaning bath at 30 C for 20 minutes, a cleaning bath at 40 C for 20 minutes, a cleaning bath at 50 C for 20 minutes, and/or a cleaning bath at 60 C for 20 minutes. This may be followed by coagulation step 122, cleaning step 124, drying 126, and then a second dip using 55% water, 45% Phosphazene at 130 degrees C. for 20 minutes in step 128. An embossing step 130 may be performed following the second dip.

Figures 2A, 2B:
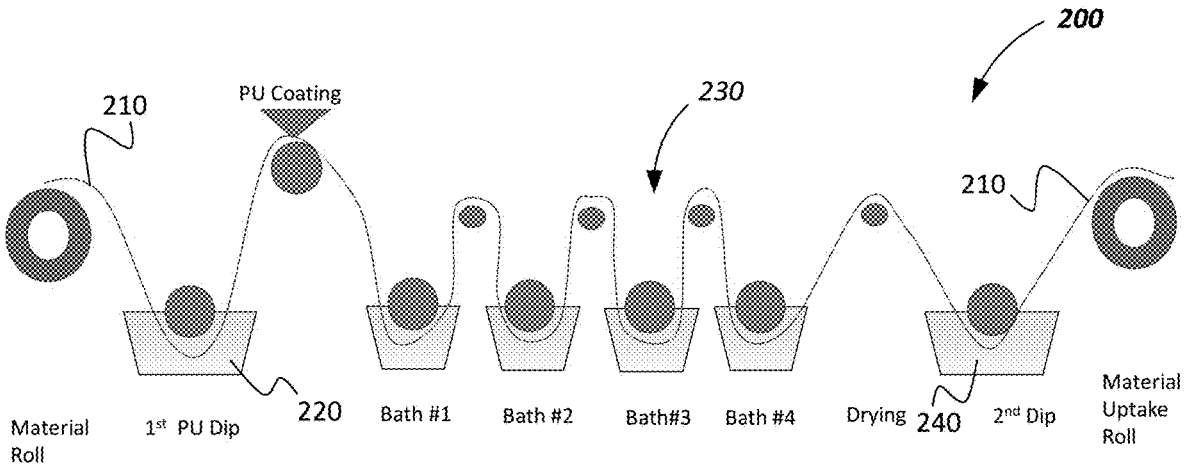
FIG. 2A is a schematic diagram of the wet-on-wet process for impregnating a material with bio-based polyurethane, and low flame polyurethane.
FIG. 2B is a table that shows material properties of a material after impregnation.

FIG. 2A is a schematic diagram of the wet-on-wet process for impregnating a material with Bio-preferred, and low flame polyurethane. In some examples, a polyurethane resin may be used to impregnate a high-loft cotton fabric 210. In some examples, the preferred polyurethane resin may include a petrol-based polyether polyurethane, a corn starch-based Bio-polyurethane, and DBDPE at concentrations of 90%, 9.5%, and 0.5%. This preferred polyurethane mix may be applied via a dipping process 220, common to the textile industry for applying resins to fabric. The preferred cotton fabric 210 may be introduced to the polyurethane resin in a polyurethane dipping bath 220. The fabric may then be then cleaned 230 at increasing temperature ranging from 30-60 degrees and dried according to industry standards before it is dipped for a second time in second dipping bath 240. The DBDPE in combination with the Bio-polyurethane may improve the fire resistance characteristics. Specifically, the carbon-based plant content of the Bio-polyurethane may be carbonized and will not continue to burn and melt. Therefore, char-length and no-melt performance may be improved. The cotton-based fabric may also improve fire resistance properties as the natural fibers of cotton will not melt.

The second dipping bath 240 of the textile may be completed with a solution of 55% water and 45% phosphazene, which imparts further fire resistance. Importantly, the water and phosphazene solution may be absorbed into the material, impregnating all of the material with fire resistance chemicals thus improving the fire resistance capabilities of the glove.

In some examples, the process described above is a "wet-on-wet" process 200, which includes a polyurethane dipping, coating, & washing, and a second dipping with fire resistance chemicals. Advantageously, this wet-on-wet process may allow for a more efficient manufacturing cycle. In comparison to a conventional process that includes impregnation, coagulation, cleaning, and coating for 200 minutes, the process shown may be completed in 100 minutes of processing time by reducing drying time between the first and second dipping. Additionally, performing the second dipping bath 240 prior to a full drying cycle may also improve fire resistance performance as the additional fire resistance chemicals are allowed to absorb into the material.

FIG. 2B is a table of material physical properties of one example of the resulting impregnant fire resistant material including thickness, weight, tensile strength, elongation, tear strength, abrasion, crocking, solvent wicking, PVC migration and UV/Sun test. Table A below also shows the results of a ASTM D6413 Vertical Flame Test used to determine flame resistance:

TABLE A

| Material | Afterflame (sec) L/W-less than 2 sec | Afterglow (sec) L/W-0 sec | Char Length (mm) L/W-less than 6 inches (152 mm) | No Melt/ No drip |
|---|---|---|---|---|
| Fire-resistant material according to the present disclosure | 0/0 | None | 89/108 (3.5/ 4.25 inches) | No melt/ no drip |

By way of explanation, afterflame is the number of seconds during which there is a visible flame remaining on the fabric with a goal of less than 2 seconds. Afterglow is the number of seconds during which there is a visible glow remaining on the fabric, and the goal is 0 seconds. Char Length is the length in inches of fabric destroyed by the flame and the goal is less than 6 inches. The occurrence of melting or dripping, if any, is also recorded. As shown, the fire-resistant material according to the present disclosure meets or exceeds all of these thresholds. Specifically, the results show 0 seconds for afterflame, no afterglow, no melting or dripping, and a char length of 3.5 inches. These are exceptional results and even more exceptional given that these fire-resistant results come from a two-layer material.

Figure 3A:
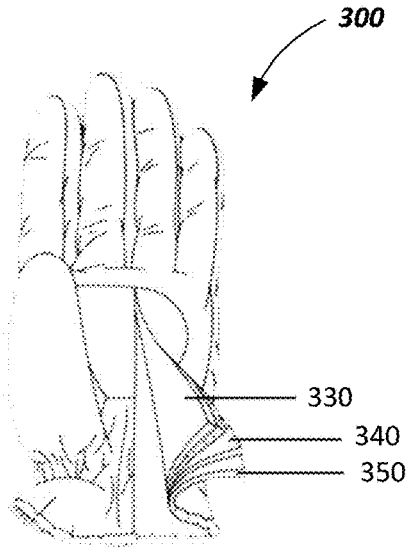
FIGS. 3A-B are schematic perspective and cross-sectional views of a conventional glove.
Figure 3B:
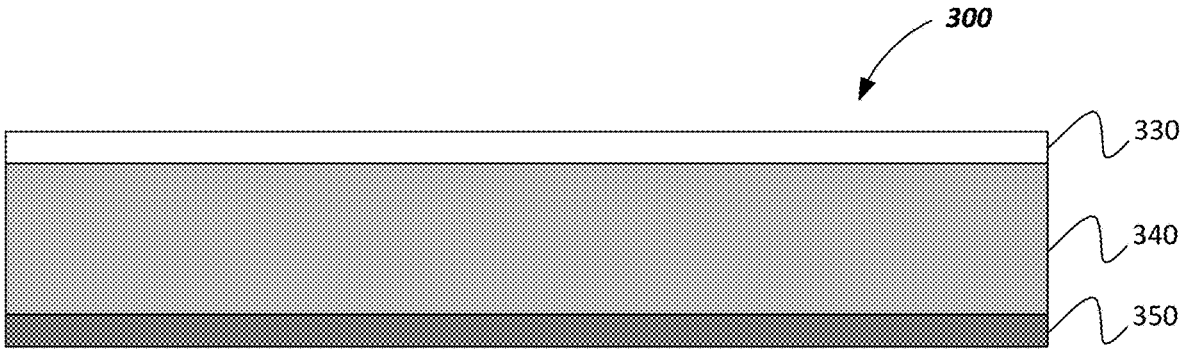

The above manufacturing process produces a fabric with exceptional fire resistance while maintaining comfort and dexterity. The disclosed fabric has advantages over the current commercial offerings for fire resistant materials used for gloves. FIG. 3A shows a standard glove using existing materials. In this example, glove 300 includes three layers of material: an inner lining 330, a Kevlar middle layer 340 and an outer leather layer 350 used to resist flame and heat. FIG. 3B shows a cross-section of a glove including the three layers 330,340,350. While being effective for fire protection, the comfort and dexterity is reduced due to the combination of the number of layers, and the increased stiffness of the materials. Moreover, these materials are costly as compared to other material choices.

Figure 4A:
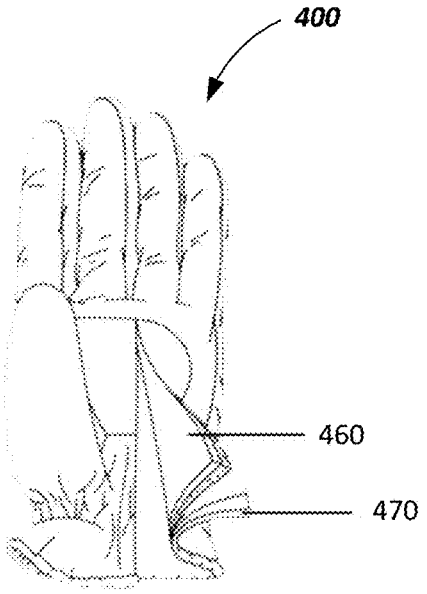
FIGS. 4A-B are schematic perspective and cross-sectional views of a glove according to one embodiment of the disclosure.
Figure 4B:
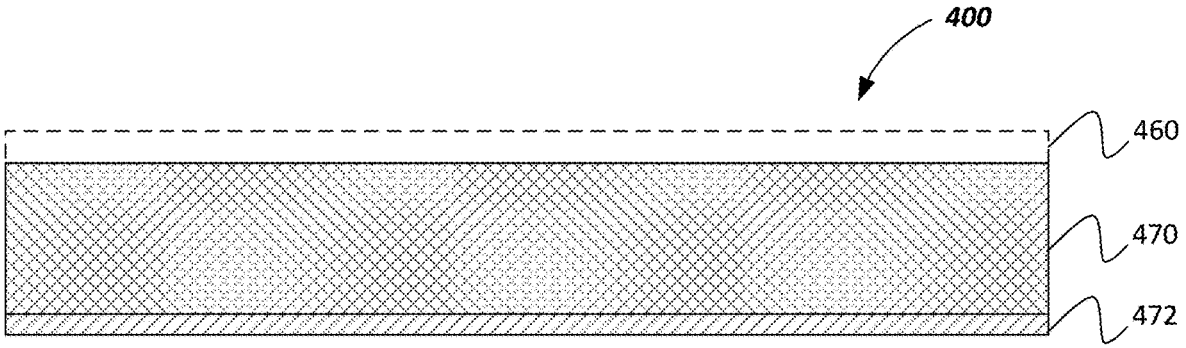

In contrast, FIGS. 4A-B show a glove 400 according to one embodiment of the present disclosure that has an inner lining fabric 460 and a polymer-impregnated base fire-resistant layer 470. As shown in the cross-section of FIG. 4B, glove 400 may include the inner lining fabric 460 closest to the user's skin. This inner lining fabric 460 may be optional. The polymer-impregnated base fire-resistant layer 470 may include any of the base material described above (e.g., cotton, polyester, etc.) and any of the polymer or polymer blends impregnated and/or coated according to the disclosed methods. In some examples, the polymer blend may create an outer shell 472 on the surface of the fire-resistant layer. As shown, the two-layer cotton-based material has fire-resistant properties equal to the common 3-layer material with better comfort and dexterity. Additionally, the construction produces a material that is softer and less stiff than conventional materials.

Thus, in some examples, a method of making a work glove includes providing a cotton base layer with a denier ranging from 150 to 200, and impregnating the cotton base layer with a polyurethane. The method may include providing a cotton base layer comprises providing CM30 yarn, knitting the CM30 yarn, and removing impurities. The method may include impregnating the cotton base layer with a polyurethane that includes a wet-on-wet process. Impregnating the cotton base layer with a polyurethane may also include a first dip with a blended resin of polyurethane, Bio-based polyurethane, and Decabromodiphenyl. The method may include undergoing at least one cleaning bath (e.g., undergoing four cleaning baths at successively increased temperatures). The method may include drying the cotton base layer having impregnated polyurethane. The method may include a second dip in water and phosphazene, and may include adding an inner fabric lining to the cotton base layer.

Figure 5:
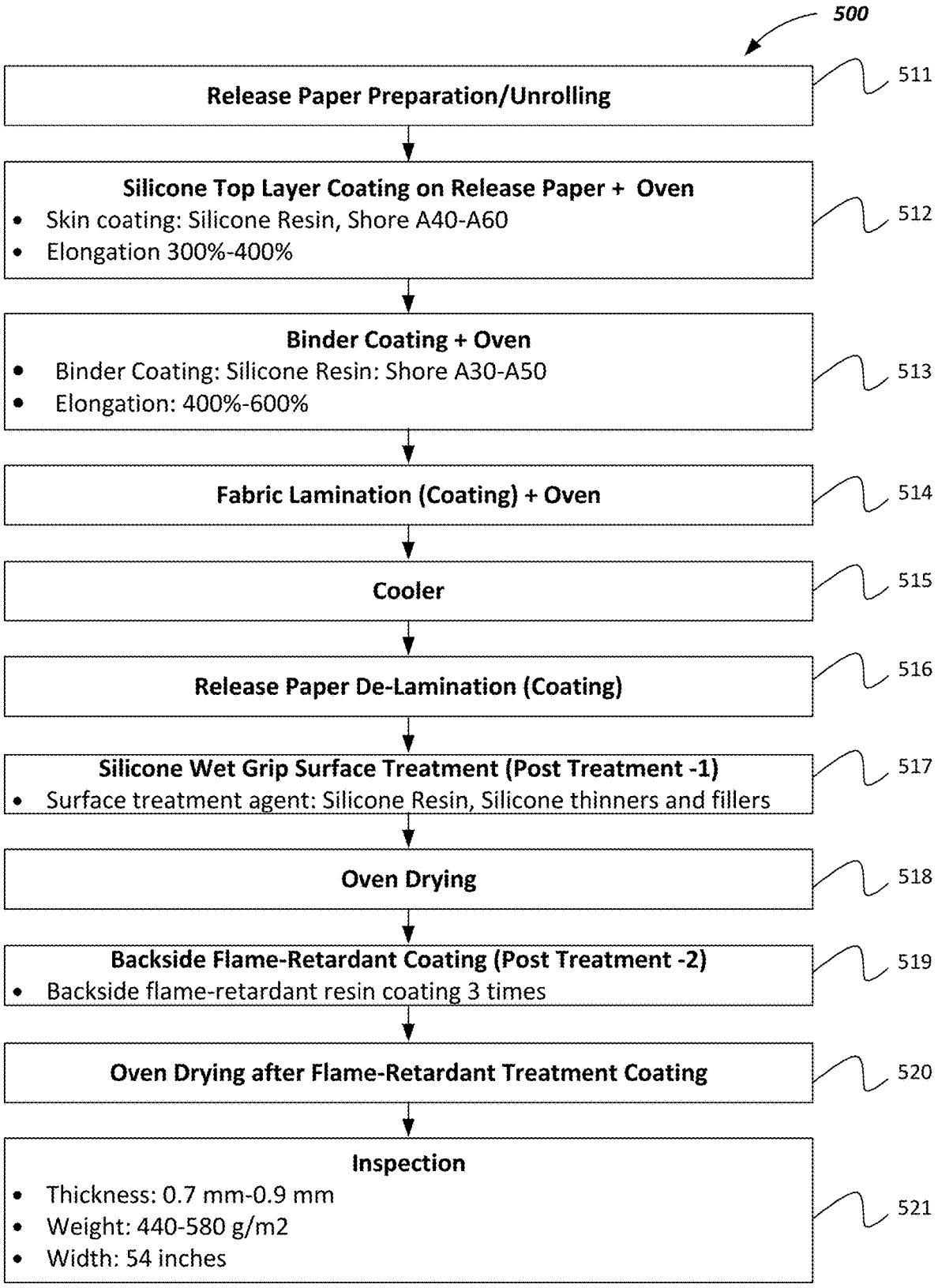
FIG. 5 is a schematic flowchart showing one possible method of silicone coating a fabric according to one embodiment.
Figure 6:
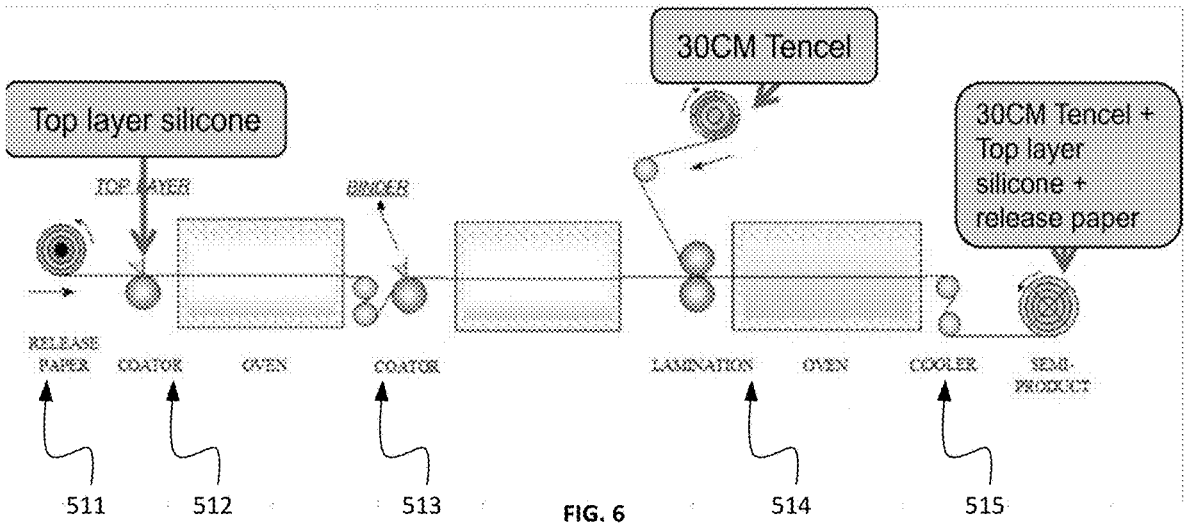
FIG. 6 is a schematic diagram showing certain steps of the method of FIG. 5.
Figure 7:
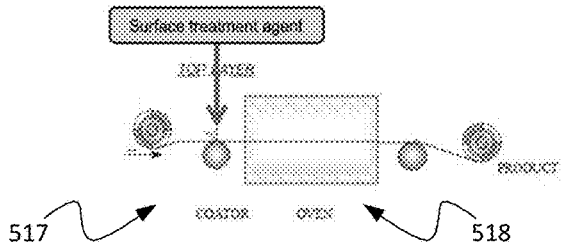
FIG. 7 is a schematic diagram showing certain steps of the method of FIG. 5.
Figure 7:
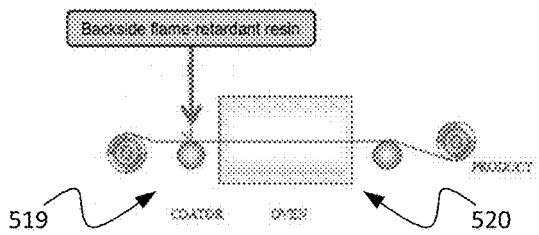

In some variations, a silicone coating process is performed instead of polyurethane impregnation. FIG. 5 illustrates one example of a silicone coating process 500 that can be used to manufacture a multi-layered fire-resistant work glove. The method begins with the preparation and unrolling of a release paper (step 511). In one example, release paper refers to the texture applied to the surface. A silicone top layer coating is then applied to the release paper surface and cured in an oven at 130-140 Celsius with a speed of 4 meters per minute (e.g., 80 meters in 20 minutes) (step 512), utilizing a silicone resin with a Shore hardness of A40-A60 and an elongation range of 300%-400%. Here, the elongation refers to the elasticity of the silicone resin. Following this, a binder coating, consisting of silicone resin with a Shore hardness of A30-A50 and an elongation range of 400%-600%, is applied and cured in an oven (step 513). The binder silicone coating may be applied to the surface of the release paper and silicone top layer and the heating/oven curing process may be performed as previous noted (e.g., 130-140 Celsius with a speed of 4 meters per minute). The fabric (i.e., cotton base and silicone binder/silicone top coat/release paper) is then laminated with an additional coating and subjected to oven curing at 130-140 Celsius with a speed of 4 meters per minute (step 514). Following lamination, a cooler temp rolls to decrease the laminated material temperature to form a fully-laminated silicone coated material (step 515). A schematic showing steps 511-515 is provided in FIG. 8.

The release paper is de-laminated or unwinded from the laminated package surface, which results in a desired texture based on the release paper design (step 516). The next stage involves applying a silicone wet grip surface treatment, using a mixture of silicone resin, thinners, and fillers as the surface treatment agent (step 517). Here, the surface of the material is coated with treatment to provide wet grip properties. Because silicone will get slippery in wet conditions, this treatment allows consistent grip in wet/dry conditions. This is followed by oven drying at 120 Celsius at a speed of 4 meters/minute (step 518). A backside flame-retardant coating is applied, consisting of three layers of flame-retardant resin (step 519). This may include upside down roll coating to coat the backside of the material to enhance cotton base fire-resistant properties. In some examples, the fire-resistant resins may include phosphate and/or phospinate. The fabric is once again oven dried at 130-140 Celsius with a speed of 4 meters per minute (step 520). Finally, the coated fabric undergoes inspection to ensure it meets the specified parameters, which may include, but are not limited to the following parameters: a thickness of 0.7 mm to 0.9 mm, a weight of 440-580 g/m$^2$, and a width of 54 inches (step 521). A schematic showing steps 517-520 is provided in FIG. 9. Once dried and inspected, the material may be rolled back up for packaging. Thus, this method yields a high-performance fabric suitable for various industrial applications requiring durability, flexibility, and safety.

One familiar in the art will understand that various versions of the disclosure are possible by altering the materials, denier, yarn count, staple length, and/or other factors. Thus, in some examples, a method of manufacturing a glove includes creating a cotton base that is loftier than standard construction that increases comfort and allows greater permeation of a fire-resistant polymer into and between the spaces in the cotton, thus providing and overall improvement in fire protection. Additionally, the fire-resistant polymer may include a Bio-based polymer of a specific formula and manufacturing process.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

The invention claimed is:

1. A method of making a work glove comprising:
providing a release paper having a first surface;
coating the first surface of the release paper with silicone to form a release paper assembly;
applying a binder coating including a silicone resin to the release paper assembly; and
providing a cotton base layer with a denier ranging from 150 to 200 and laminating the cotton base layer to the release paper assembly.

2. The method of claim 1, wherein coating the first surface of the release paper with silicone comprises applying a silicone top layer coating to the first surface and curing the release paper assembly in an oven.

3. The method of claim 2, wherein curing the release paper assembly in an oven comprises curing the assembly at 130-140 degrees Celsius.

4. The method of claim 2, wherein coating the first surface of the release paper with silicone comprises coating with a silicone resin having a Shore hardness of A40-A60 and an elongation range of 300%-400%.

5. The method of claim 2, further comprising the step of laminating the assembly with an additional coating and subjecting it to oven curing before cooling it.

6. The method of claim 5, further comprising the step of removing the release paper after the step of laminating the assembly.

7. The method of claim 1, further comprising the step of applying a silicone wet grip surface treatment using a mixture of silicone resin, thinners, and/or fillers as the surface treatment agent.

8. The method of claim 1, further comprising applying a backside flame-retardant coating to the second surface.

9. The method of claim 1, further comprising the step of inspecting the work glove so that a thickness is between 0.7 mm to 0.9 mm, and a weight is between 440-580 g/m$^2$.

10. A method of making a work glove comprising:
providing a release paper having a first surface;
coating the first surface of the release paper with silicone to form a release paper assembly;
applying a binder coating including a silicone resin to the release paper assembly; and providing a cotton base layer with a denier ranging from 150 to 200 and laminating the cotton base layer to the release paper assembly, wherein coating the first surface of the release paper comprises coating the first surface with a silicone top layer to form a release paper assembly, and wherein applying a binder coating comprises applying a silicone resin to the silicone top layer of the release paper assembly, and wherein the binder coating is placed through an oven curing process prior to laminating the cotton base layer to the release paper assembly.

* * * * *